US010714044B1

(12) United States Patent
Zhang et al.

(10) Patent No.: US 10,714,044 B1
(45) Date of Patent: Jul. 14, 2020

(54) GOA CIRCUIT AND DISPLAY DEVICE

(71) Applicant: WUHAN CHINA STAR OPTOELECTRONICS TECHNOLOGY CO., LTD., Wuhan (CN)

(72) Inventors: Xin Zhang, Wuhan (CN); Juncheng Xiao, Wuhan (CN); Yanqing Guan, Wuhan (CN); Chao Tian, Wuhan (CN)

( * ) Notice: Subject to any disclaimer, the term of this patent is extended or adjusted under 35 U.S.C. 154(b) by 0 days.

(21) Appl. No.: 16/349,625

(22) PCT Filed: Oct. 10, 2018

(86) PCT No.: PCT/CN2018/109665

§ 371 (c)(1),
(2) Date: May 14, 2019

(87) PCT Pub. No.: WO2020/019527

PCT Pub. Date: Jan. 30, 2020

(30) Foreign Application Priority Data

Jul. 24, 2018 (CN) ..... 2018 1 0820130

(51) Int. Cl.
*G09G 3/36* (2006.01)

(52) U.S. Cl.
CPC ... *G09G 3/3677* (2013.01); *G09G 2310/0283* (2013.01); *G09G 2320/0214* (2013.01)

(58) Field of Classification Search
CPC ..... G09G 3/3677; G09G 2310/0283; G09G 2320/0214
See application file for complete search history.

(56) References Cited

U.S. PATENT DOCUMENTS

| | | | | |
|---|---|---|---|---|
| 9,066,035 | B2 * | 6/2015 | Kurokawa | G02F 1/1362 |
| 2017/0221441 | A1 * | 8/2017 | Gu | G06F 3/044 |
| 2018/0046311 | A1 * | 2/2018 | Gu | G09G 3/3677 |
| 2019/0180108 | A1 * | 6/2019 | Catalano | H04N 21/812 |
| 2019/0180708 | A1 | 6/2019 | Hong | |

FOREIGN PATENT DOCUMENTS

| | | | |
|---|---|---|---|
| CN | 105047168 | A | 11/2015 |
| CN | 105679262 | A | 6/2016 |
| CN | 105976781 | A | 9/2016 |
| CN | 108010495 | A | 5/2018 |
| CN | 108091308 | A | 5/2018 |

* cited by examiner

*Primary Examiner* — Andrew Sasinowski

(57) ABSTRACT

A gate driver of array (GOA) circuit and a display device are disclosed. An n-th sub-circuit in the GOA circuit includes a control module, an output module, a pull-up supplement module, and a leakage switch. The pull-up supplement module includes a supplement switch and an auxiliary switch. The supplement switch is coupled to the auxiliary switch, the control module, and the output module. The auxiliary switch is coupled to the supplement switch, the control module, and the output module. The leakage switch is coupled to the control module, the output module, the supplement switch, and the auxiliary switch.

17 Claims, 3 Drawing Sheets

GOA CIRCUIT AND DISPLAY DEVICE

FIELD OF INVENTION

The present disclosure relates to the technical field of displays, and specifically to a gate driver on array (GOA) circuit and a display device, which may be used for liquid crystal display.

BACKGROUND OF INVENTION

Currently, liquid crystal displays (LCDs) are widely used in various electronic products. An important component in a liquid crystal display is a gate driver on array (GOA) circuit. The GOA circuit mainly uses a gate-row-scanned driving circuit that is fabricated on an array substrate using an array process of a thin film transistor (TFT) liquid crystal display to realize progressive scanning of a gate of each of pixel transistors.

In display panel technology, low temperature poly-silicon (LTPS) based technology is divided into types of n-type metal oxide semiconductor (NMOS), p-type metal oxide semiconductor (PMOS), and complementary metal oxide semiconductor (CMOS) including NMOS and PMOS, according to the types of thin field transistors used in panels. Similarly, the GOA circuit is also divided into circuits of NMOS, PMOS, and CMOS. Compared with the CMOS circuit, a P-type doped photomask and the process may be eliminated in an NMOS circuit. That is helpful for improving yield and reducing cost, so development of a stable NMOS circuit has industrial demand.

However, since carriers of an NMOS type TFT are electrons, and mobility of the electrons is higher than that of holes. Therefore, an NMOS device is more susceptible to damage than a PMOS device (carriers thereof are holes). The performance of the panels is insufficient to the high temperature reliability of the product, and the GOA circuit is easily to fail, causing a split-screen phenomenon to the panels. Especially, for an in-cell touch panel (ITP), it is more likely that the split-screen phenomenon occurs in a pause stage for a touch panel (TP). Because a TFT is not an ideal switching device, even if in a case of an off state, there will still be a certain leakage current. If the pause stage for the TP needs to maintain high voltage for a long time, the stability of the GOA will be reduced. In the past, although the GOA circuit blocked an electrical leakage path to try to solve the above problems, it still needs to be improved.

Thus, a GOA circuit and a display device are urgently needed to solve the above problems.

SUMMARY OF INVENTION

An object of the present disclosure is to provide a gate driver on array (GOA) circuit that avoids leakage current of transistors causing failure of the GOA circuit, to improve stability of transmission between cascaded sub-circuits.

Another object of the present disclosure is to provide a display device that is able to improve stability of transmission between cascaded sub-circuits, to improve reliability of products.

In order to achieve the above object of the present disclosure, an aspect of the present disclosure provides a GOA circuit, which includes a plurality of cascaded sub-circuits, wherein an n-th sub-circuit of the sub-circuits includes: a control module electrically connected to a positive scan control terminal, a negative scan control terminal, an (n−2)th scan terminal, an (n+2)th scan terminal, an (n+1)th clock terminal, an (n−1)th clock terminal, a high voltage terminal, and a low voltage terminal; an output module electrically connected to the high voltage terminal, the low voltage terminal, an n-th clock terminal, an n-th scan terminal, and a controllable terminal; a pull-up supplement module comprising a supplement switch and an auxiliary switch, the supplement switch is electrically connected to the auxiliary switch, the high voltage terminal, the control module, and the output module, the auxiliary switch is electrically connected to the supplement switch, the high voltage terminal, the control module, and the output module; and a leakage switch electrically connected to the control module, the output module, the supplement switch, the auxiliary switch, and the low voltage terminal; wherein the control module comprises a first switch, a second switch, a third switch, a fourth switch, a fifth switch, and a sixth switch; wherein the first switch is electrically connected to the (n−2)th scan terminal, the positive scan control terminal, the second switch, the sixth switch, the supplement switch, and the auxiliary switch; wherein the second switch is electrically connected to the (n+2)th scan terminal, the negative scan control terminal, the first switch, the sixth switch, the supplement switch, and the auxiliary switch; wherein the third switch is electrically connected to the positive scan control terminal, the (n+1)th clock terminal, the fourth switch, and the fifth switch; wherein the fourth switch is electrically connected to the negative scan control terminal, the (n−1)th clock terminal, the third switch, and the fifth switch; wherein the fifth switch is electrically connected to the high voltage terminal, the third switch, the fourth switch, the sixth switch, the leakage switch, and the output module; and wherein the sixth switch is electrically connected to the low voltage terminal, the first switch, the second switch, the fifth switch, the supplement switch, the auxiliary switch, the output module, and the leakage switch; and wherein the output module comprises a relay unit, a pull-up unit, a pull-down unit, a detection unit, a first energy storing element, and a second energy storing element; wherein the relay unit is electrically connected to the high voltage terminal, the supplement switch, the auxiliary switch, and the pull-up unit; wherein the relay unit, the supplement switch, and the auxiliary switch are commonly connected to form a first node; wherein the pull-up unit is electrically connected to the relay unit, the n-th clock terminal, and the n-th scan terminal; wherein the pull-down unit is electrically connected to the n-th scan terminal, the low voltage terminal, the leakage switch, and the control module; wherein the detection unit is electrically connected to the n-th scan terminal, the low voltage terminal, the controllable terminal, the pull-down unit, the leakage switch, and the control module; wherein the pull-down unit, the detection unit, the leakage switch, and the control module are commonly connected to a second node; wherein the first energy storing element is electrically connected between the first node and the low voltage terminal; and wherein the second energy storing element is electrically connected between the second node and the low voltage terminal.

In an embodiment of the present disclosure, a control end of the supplement switch is electrically connected to a first end of the auxiliary switch and the control module; a first end of the supplement switch and a control end of the auxiliary switch are electrically connected to the high voltage terminal; and a second end of the supplement switch is electrically connected to a second end of the auxiliary switch and the output module.

In an embodiment of the present disclosure, a control end of the leakage switch is electrically connected to the control module and the output module; a first end of the leakage switch is electrically connected to the first end of the auxiliary switch or the second end of the auxiliary switch; and a second end of the leakage switch is electrically connected to the low voltage terminal.

In an embodiment of the present disclosure, the relay unit includes a seventh switch; a control end of the seventh switch is electrically connected to the high voltage terminal; a first end of the seventh switch is electrically connected to the first node; and a second end of the seventh switch is electrically connected to the pull-up unit.

In an embodiment of the present disclosure, the pull-up unit includes an eighth switch; a control end of the eighth switch is electrically connected to the relay unit; a first end of the eighth switch is electrically connected to the n-th clock terminal; and a second end of the eighth switch is electrically connected to the n-th scan terminal.

In an embodiment of the present disclosure, the pull-down unit includes a ninth switch; a control end of the ninth switch is electrically connected to the second node; a first end of the ninth switch is electrically connected to the n-th scan terminal; and a second end of the ninth switch is electrically connected to the low voltage terminal.

In an embodiment of the present disclosure, the detection unit includes a tenth switch, an eleventh switch, and a twelfth switch; a control end of the tenth switch is electrically connected to a first end of the tenth switch and a control end of the eleventh switch; a second end of the tenth switch is electrically connected to the n-th scan terminal; a first end of the eleventh switch is electrically connected to the second node; a second end of the eleventh switch is electrically connected to the low voltage terminal; a control end of the twelfth switch is electrically connected to the controllable terminal; a first end of the twelfth switch is electrically connected to the n-th scan terminal; and a second end of the twelfth switch is electrically connected to the low voltage terminal.

In order to achieve the above object of the present disclosure, another aspect of the present disclosure provides a GOA circuit, which includes a plurality of cascaded sub-circuits, wherein an n-th sub-circuit of the sub-circuits includes: a control module electrically connected to a positive scan control terminal, a negative scan control terminal, an (n−2)th scan terminal, an (n+2)th scan terminal, an (n+1)th clock terminal, an (n−1)th clock terminal, a high voltage terminal, and a low voltage terminal; an output module electrically connected to the high voltage terminal, the low voltage terminal, an n-th clock terminal, an n-th scan terminal, and a controllable terminal; a pull-up supplement module comprising a supplement switch and an auxiliary switch, the supplement switch is electrically connected to the auxiliary switch, the high voltage terminal, the control module, and the output module, the auxiliary switch is electrically connected to the supplement switch, the high voltage terminal, the control module, and the output module; and a leakage switch electrically connected to the control module, the output module, the supplement switch, the auxiliary switch, and the low voltage terminal.

In an embodiment of the present disclosure, a control end of the supplement switch is electrically connected to a first end of the auxiliary switch and the control module; a first end of the supplement switch and a control end of the auxiliary switch are electrically connected to the high voltage terminal; and a second end of the supplement switch is electrically connected to a second end of the auxiliary switch and the output module.

In an embodiment of the present disclosure, a control end of the leakage switch is electrically connected to the control module and the output module; a first end of the leakage switch is electrically connected to the first end of the auxiliary switch or the second end of the auxiliary switch; and a second end of the leakage switch is electrically connected to the low voltage terminal.

In an embodiment of the present disclosure, the control module includes a first switch, a second switch, a third switch, a fourth switch, a fifth switch, and a sixth switch; wherein the first switch is electrically connected to the (n−2)th scan terminal, the positive scan control terminal, the second switch, the sixth switch, the supplement switch, and the auxiliary switch; wherein the second switch is electrically connected to the (n+2)th scan terminal, the negative scan control terminal, the first switch, the sixth switch, the supplement switch, and the auxiliary switch; wherein the third switch is electrically connected to the positive scan control terminal, the (n+1)th clock terminal, the fourth switch, and the fifth switch; wherein the fourth switch is electrically connected to the negative scan control terminal, the (n−1)th clock terminal, the third switch, and the fifth switch; wherein the fifth switch is electrically connected to the high voltage terminal, the third switch, the fourth switch, the sixth switch, the leakage switch, and the output module; and wherein the sixth switch is electrically connected to the low voltage terminal, the first switch, the second switch, the fifth switch, the supplement switch, the auxiliary switch, the output module, and the leakage switch.

In an embodiment of the present disclosure, the output module includes a relay unit, a pull-up unit, a pull-down unit, a detection unit, a first energy storing element, and a second energy storing element; wherein the relay unit is electrically connected to the high voltage terminal, the supplement switch, the auxiliary switch, and the pull-up unit; wherein the relay unit, the supplement switch, and the auxiliary switch are commonly connected to form a first node; wherein the pull-up unit is electrically connected to the relay unit, the n-th clock terminal, and the n-th scan terminal; wherein the pull-down unit is electrically connected to the n-th scan terminal, the low voltage terminal, the leakage switch, and the control module; wherein the detection unit is electrically connected to the n-th scan terminal, the low voltage terminal, the controllable terminal, the pull-down unit, the leakage switch, and the control module; wherein the pull-down unit, the detection unit, the leakage switch, and the control module are commonly connected to a second node; wherein the first energy storing element is electrically connected between the first node and the low voltage terminal; and wherein the second energy storing element is electrically connected between the second node and the low voltage terminal.

In an embodiment of the present disclosure, the relay unit includes a seventh switch; a control end of the seventh switch is electrically connected to the high voltage terminal; a first end of the seventh switch is electrically connected to the first node; and a second end of the seventh switch is electrically connected to the pull-up unit.

In an embodiment of the present disclosure, the pull-up unit includes an eighth switch; a control end of the eighth switch is electrically connected to the relay unit; a first end of the eighth switch is electrically connected to the n-th clock terminal; and a second end of the eighth switch is electrically connected to the n-th scan terminal.

In an embodiment of the present disclosure, the pull-down unit includes a ninth switch; a control end of the ninth switch is electrically connected to the second node; a first end of the ninth switch is electrically connected to the n-th scan terminal; and a second end of the ninth switch is electrically connected to the low voltage terminal.

In an embodiment of the present disclosure, the detection unit includes a tenth switch, an eleventh switch, and a twelfth switch; a control end of the tenth switch is electrically connected to a first end of the tenth switch and a control end of the eleventh switch; a second end of the tenth switch is electrically connected to the n-th scan terminal; a first end of the eleventh switch is electrically connected to the second node; a second end of the eleventh switch is electrically connected to the low voltage terminal; a control end of the twelfth switch is electrically connected to the controllable terminal; a first end of the twelfth switch is electrically connected to the n-th scan terminal; and a second end of the twelfth switch is electrically connected to the low voltage terminal.

In order to achieve the above object of the present disclosure, another aspect of the present disclosure provides a display device, which includes an array substrate and a GOA circuit as described above, wherein the GOA circuit is disposed on the array substrate.

Compared with the prior art, the GOA circuit and the display device of the present disclosure are provided with the pull-up supplement module. If the leakage switch has a certain leakage current during the touch period to cause voltage at the first node being decreased. At the same time, because the supplemental switch of the pull-up supplemental module also has a certain leakage current to increase the voltage at the first node, thereby relieving influence of leakage current of the leakage switch to the voltage at the first node. Therefore, control margin of the circuit during a touch period is increased, so that the circuit operates normally and reliability of the circuit is improved.

DETAILED DESCRIPTION OF PREFERRED EMBODIMENTS

The following description of each embodiment refers to the appended drawings for illustrating specific embodiments in which the present disclosure may be practiced. Directional terms as mentioned in the present disclosure, such as "up", "down", "front", "rear", "left", "right", "inside", "outside", "lateral", etc., are merely used for the purpose of illustrating and understanding the present disclosure and are not intended to be limiting of the present disclosure.

Figure 1:
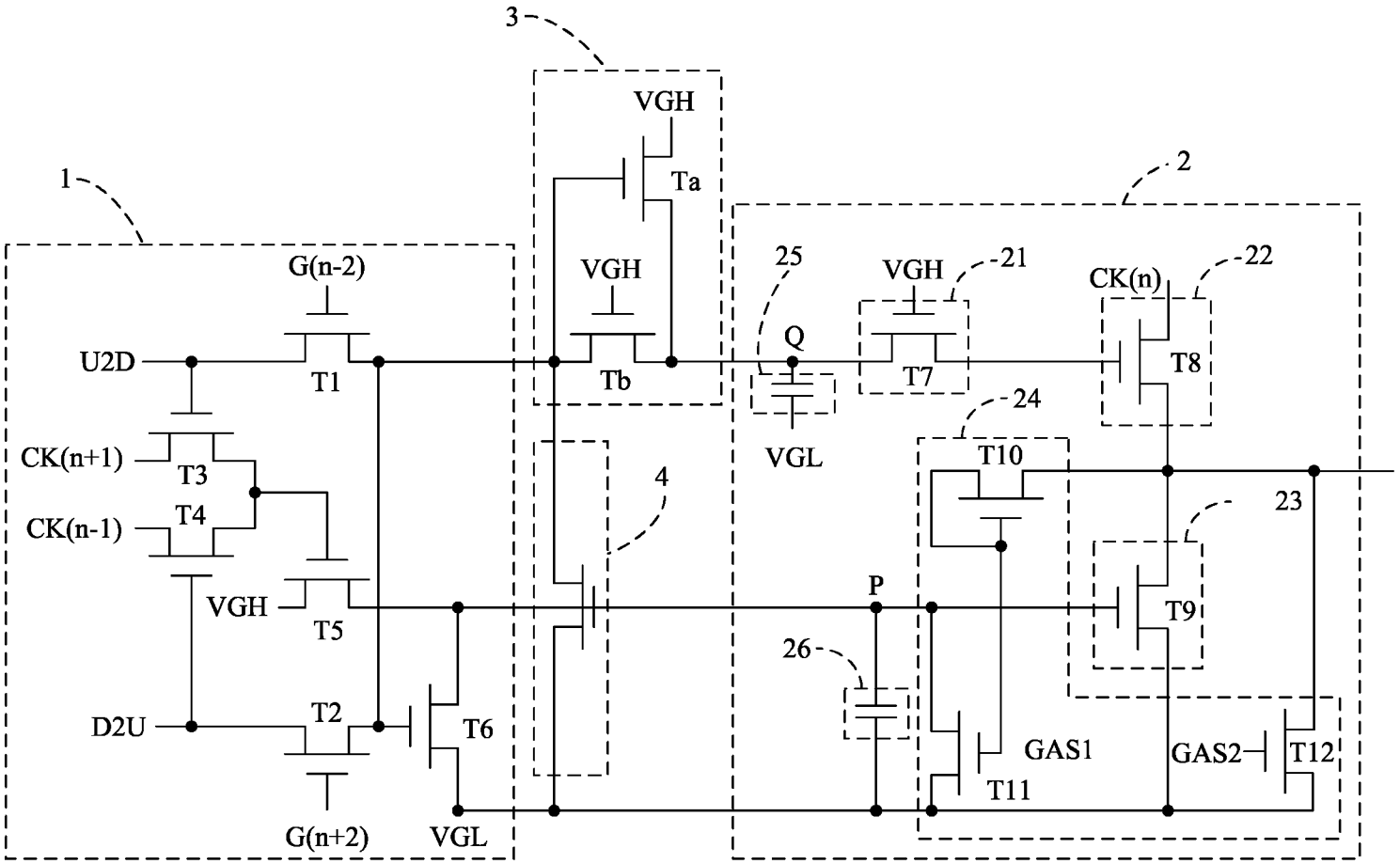
FIG. 1 is a schematic diagram of a gate driver on array (GOA) circuit according to a first embodiment of the present disclosure.

Please refer to FIG. 1, an aspect of the present disclosure includes a gate driver on array (GOA) circuit, which is able to be used for controlling a display panel based on low temperature poly-silicon (LTPS) technology. A type of a thin film transistor (TFT) adopted in the display panel may be an n-type metal oxide semiconductor (NMOS) transistor. A switch described later may have a control end (such as a gate of the transistor), a first end (such as one of a source and a drain of the transistor), and a second end (such as the other of the source and the drain of the transistor).

Please refer to FIG. 1, the GOA circuit may include a plurality of cascaded sub-circuits. Hereafter, only an n-th sub-circuit is taken as an example. For example, n may be a positive integer representing one of the cascaded sub-circuits, and the remaining sub-circuits are the same as the n-th sub-circuit. It can be understood by those skilled in the art, and will not be described here. The n-th sub-circuit of the cascaded sub-circuits may include: a control module 1, an output module 2, a pull-up supplement module 3, and a leakage switch 4. An embodied example of the GOA circuit according to one embodiment of the present disclosure is illustrated below, but is not limited as described here.

Please refer to FIG. 1, the control module 1 may be electrically connected to a positive scan control terminal U2D, a negative scan control terminal D2U, an (n−2)th scan terminal G(n−2), an (n+2)th scan terminal G(n+2), an (n+1)th clock terminal CK(n+1), an (n−1)th clock terminal CK(n−1), a high voltage terminal VGH, and a low voltage terminal VGL. The output module 2 may be electrically connected to the high voltage terminal VGH, the low voltage terminal VGL, an n-th clock terminal CK(n), an n-th scan terminal G(n), and a controllable terminal GAS2. The pull-up supplement module 3 may include a supplement switch Ta and an auxiliary switch Tb, wherein the supplement switch Ta is electrically connected to the auxiliary switch Tb, the high voltage terminal VGH, the control module 1, and the output module 2, and the auxiliary switch Tb is electrically connected to the supplement switch Ta, the high voltage terminal VGH, the control module 1, and the output module 2. The leakage switch 4 may be electrically connected to the control module 1, the output module 2, the supplement switch Ta, the auxiliary switch Tb, and the low voltage terminal VGL.

It should be understood that, the positive scan control terminal U2D and the negative scan control terminal D2U may be used to input signals to control a progressive scan order. For example, if a constant high voltage signal is input to the positive scan control terminal U2D and a constant low voltage signal is input to the negative scan control terminal D2U, the progressive scan order is from top to bottom. Alternatively, if the constant low voltage signal is input to the positive scan control terminal U2D and the constant high voltage signal is input to the negative scan control terminal D2U, the progressive scan order is from bottom to top.

In addition, the (n−2)th scan terminal G(n−2) and the (n+2)th scan terminal G(n+2) may be used to input signals output from scan terminals of the (n−2)th sub-circuit and the (n+2)th sub-circuit. The (n+1)th clock terminal CK(n+1), the n-th clock terminal CK(n), and (n−1)th clock terminal CK(n−1) may input clock signals that are used for the (n+1)th sub-circuit, the n-th sub-circuit, and the (n−1) sub-circuit. The n-th scan terminal G(n) may be used to output an n-th scan signal that is used to progressively scan gates of pixel transistors. The high voltage terminal VGH and the low voltage terminal VGL may be used to input a high voltage signal and a low voltage signal in which voltage can be adjusted with a fabrication process of the transistors. The controllable terminal GAS2 may be used to input a control signal, such as a pulse signal, that is used to cooperate with a state of touch panel (TP) term holding, for example, the controllable signal is high voltage within a TP term and is low voltage within the other term, which is understandable to those skilled in the art and is not be described here.

In an embodiment, as shown in FIG. 1, the control module 1 may include a first switch T1, a second switch T2, a third switch T3, a fourth switch T4, a fifth switch T5, and a sixth switch T6.

A control end of the first switch T1 is electrically connected to the (n−2)th scan terminal G(n−2). A first end of the first switch T1 is electrically connected to the positive scan control terminal U2D. A second end of the first switch T1 is electrically connected to a second end of the second switch T2, a control end of the sixth switch T6, a control end of the supplement switch Ta, and a first end of the auxiliary switch Tb.

A control end of the second switch T2 is electrically connected to the (n+2)th scan terminal G(n+2). A first end of the second switch T2 is electrically connected to the negative scan control terminal D2U. The second end of the second switch T2 is electrically connected to the second end of the first switch T1, the control end of the sixth switch T6, the control end of the supplement switch Ta, and the first end of the auxiliary switch Tb.

A control end of the third switch T3 is electrically connected to the positive scan control terminal U2D. A first end of the third switch T3 is electrically connected to the (n+1)th clock terminal CK(n+1). A second end of the third switch T3 is electrically connected to a second end of the fourth switch T4 and a control end of the fifth switch T5.

The control end of the fourth switch T4 is electrically connected to the negative scan control terminal D2U. A first end of the fourth switch T4 is electrically connected to the (n−1)th clock terminal CK(n−1). The second end of the fourth switch T4 is electrically connected to the second end of the third switch T3 and a control end of the fifth switch T5.

The control end of the fifth switch T5 is electrically connected to the second end of the third switch T3 and the second end of the fourth switch T4. A first end of the fifth switch T5 is electrically connected to the high voltage terminal. A second end of the fifth switch T5 is electrically connected to a first end of the sixth switch T6, a control end of the leakage switch 4, and the output module 2.

The control end of the sixth switch T6 is electrically connected to the second end of the first switch T1, the second end of the second switch T2, the control end of the supplement switch Ta, the second end of the supplement switch Ta, and the first end of the auxiliary switch Tb. The first end of the sixth switch T6 is electrically connected to the second end of the fifth switch, the output module 2 and the control end of the leakage switch 4. The second end of the sixth switch T6 is electrically connected to the low voltage terminal.

In an embodiment, as shown in FIG. 1, the output module 2 may include a relay unit 21, a pull-up unit 22, a pull-down unit 23, a detection unit 24, a first energy storing element 25, and a second energy storing element 26.

The relay unit 21 is electrically connected to the high voltage terminal VGH, the supplement switch Ta, the auxiliary switch Tb, and the pull-up unit 22. The relay unit 21, the supplement switch Ta, and the auxiliary switch Tb are commonly connected to form a first node Q. The pull-up unit 22 is electrically connected to the relay unit 21, the n-th clock terminal CK(n), and the n-th scan terminal G(n). The pull-down unit 23 is electrically connected to the n-th scan terminal G(n), the low voltage terminal VGL, the leakage switch 4, and the control module 1. The detection unit 24 is electrically connected to the n-th scan terminal G(n), the low voltage terminal VGL, the controllable terminal GAS2, the pull-down unit 23, the leakage switch 4, and the control module 1. The pull-down unit 23, the detection unit 24, the leakage switch 4, and the control module 1 are commonly connected to a second node P. The first energy storing element 25 (e.g., capacitor) is electrically connected between the first node Q and the low voltage terminal VGL; and the second energy storing element 26 (e.g., capacitor) is electrically connected between the second node P and the low voltage terminal VGL.

Specifically, as shown in FIG. 1, the relay unit 21 includes a seventh switch T7. A control end of the seventh switch T7 is electrically connected to the high voltage terminal VGH. A first end of the seventh switch T7 is electrically connected to the first node Q. A second end of the seventh switch T7 is electrically connected to the pull-up unit 22.

Specifically, as shown in FIG. 1, the pull-up unit 22 includes an eighth switch T8. A control end of the eighth switch T8 is electrically connected to the relay unit 21. A first end of the eighth switch T8 is electrically connected to the n-th clock terminal CK(n). A second end of the eighth switch T8 is electrically connected to the n-th scan terminal G(n).

Specifically, as shown in FIG. 1, the pull-down unit 23 includes a ninth switch T9. A control end of the ninth switch T9 is electrically connected to the second node P. A first end of the ninth switch T9 is electrically connected to the n-th scan terminal G(n). A second end of the ninth switch T9 is electrically connected to the low voltage terminal VGL.

Specifically, as shown in FIG. 1, the detection unit 24 includes a tenth switch T10, an eleventh switch T11, and a twelfth switch T12. A control end of the tenth switch T10 is electrically connected to a first end of the tenth switch T10 and a control end of the eleventh switch T11. A second end of the tenth switch T10 is electrically connected to the n-th scan terminal G(n). A first end of the eleventh switch T11 is electrically connected to the second node P. A second end of the eleventh switch T11 is electrically connected to the low voltage terminal VGL. A control end of the twelfth switch T12 is electrically connected to the controllable terminal GAS2. A first end of the twelfth switch T12 is electrically connected to the n-th scan terminal G(n). A second end of the twelfth switch T12 is electrically connected to the low voltage terminal VGL.

Figure 2:
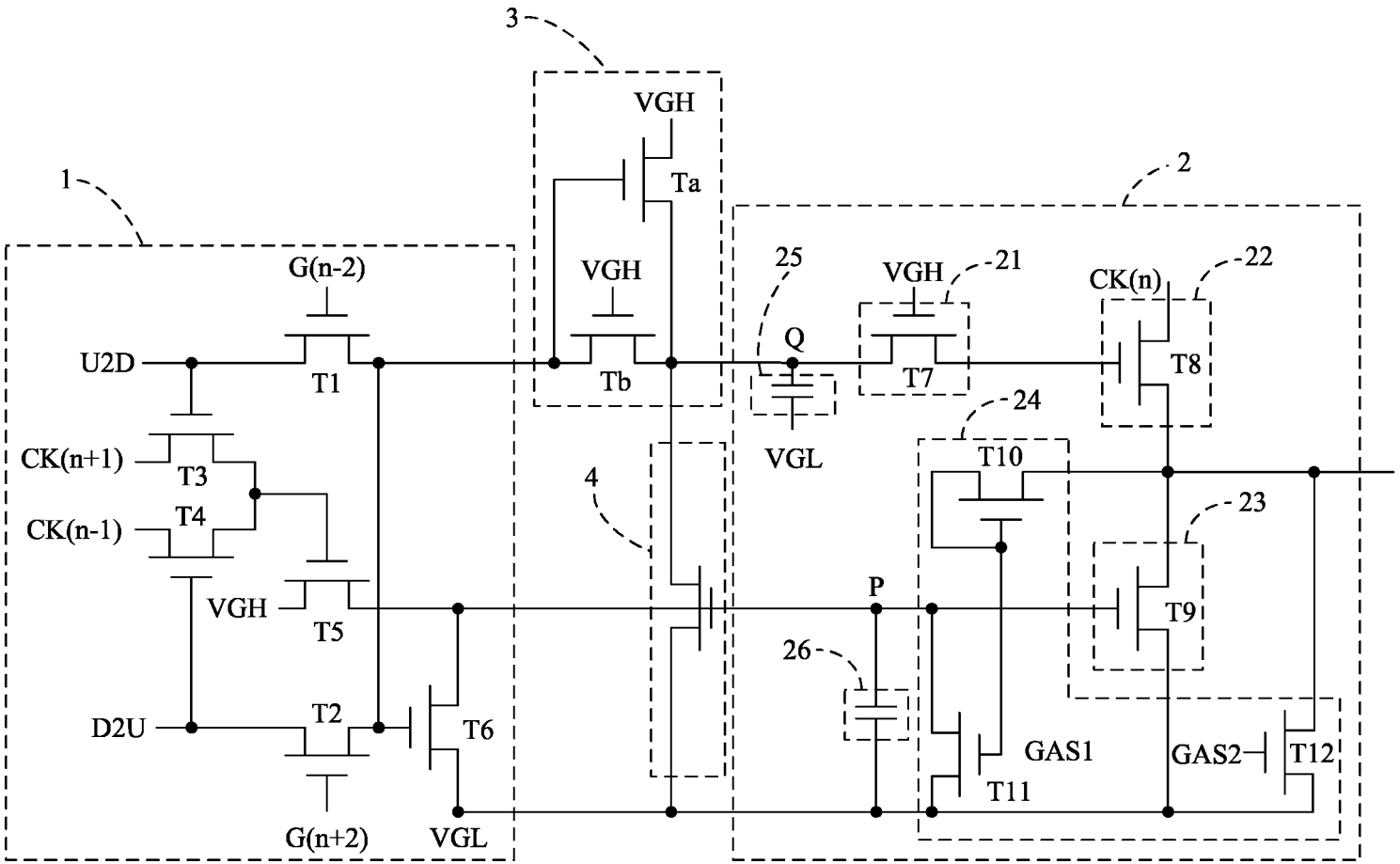
FIG. 2 is a schematic diagram of the GOA circuit according to a second embodiment of the present disclosure.

In some embodiment, as shown in FIGS. 1 and 2, the control end of the supplement switch Ta of the pull-up supplement module 3 is electrically connected to the first end of the supplement switch Tb and the first transistor T1 of the control module 1. The first end of the supplement switch Ta and the control end of the supplement switch Tb are electrically connected to the high voltage terminal VGH. The second end of the supplement switch Ta is electrically connected to a second end of the supplement switch Tb, the relay unit 21 of the output module 2, and the first energy storing element 25.

Furthermore, the control end of the leakage switch 4 is electrically connected to a fifth transistor T5 of the control module 1, a sixth transistor T6 of the control module 1, the pull-down unit 23 of the output module 2, the detection unit 24 of the output module 2, and the second energy storing element 26 of the output module 2. The first end of the leakage switch 4 is electrically connected to the first end of the auxiliary switch Tb (as shown in FIG. 1) or a second end of auxiliary switch Tb (as shown in FIG. 2). A second end of the leakage switch 4 is electrically connected to the low voltage terminal VGL.

The following description is an example of the operation of the above-mentioned GOA circuit. Taking an in-cell touch panel (ITP) as an example. It is necessary to insert a plurality of touch panel (TP) terms within displaying time over a single frame. Within the displaying time, a progressively scan order is controlled by signals input from the positive scan control terminal U2D and the negative scan control terminal D2U to cooperate with signals input via the (n−2)th scan terminal G(n−2), the (n+2)th scan terminal G(n+2), the (n+1)th clock terminal CK(n+1), the n-th clock terminal CK(n), the (n−1)th clock terminal CK(n−1), the controllable terminal GAS2, the high voltage terminal VGH, and the low voltage terminal VGL. Thus, the n-th scan signal can be output via the n-th scan terminal G(n) for progressive scan.

Within the touch panel terms, the first node Q can maintain voltage that is required for operating the circuit to ensure normal operation. The features of the GOA circuit provided with the pull-up supplement module 3 are specifically described as follows.

Figure 3:
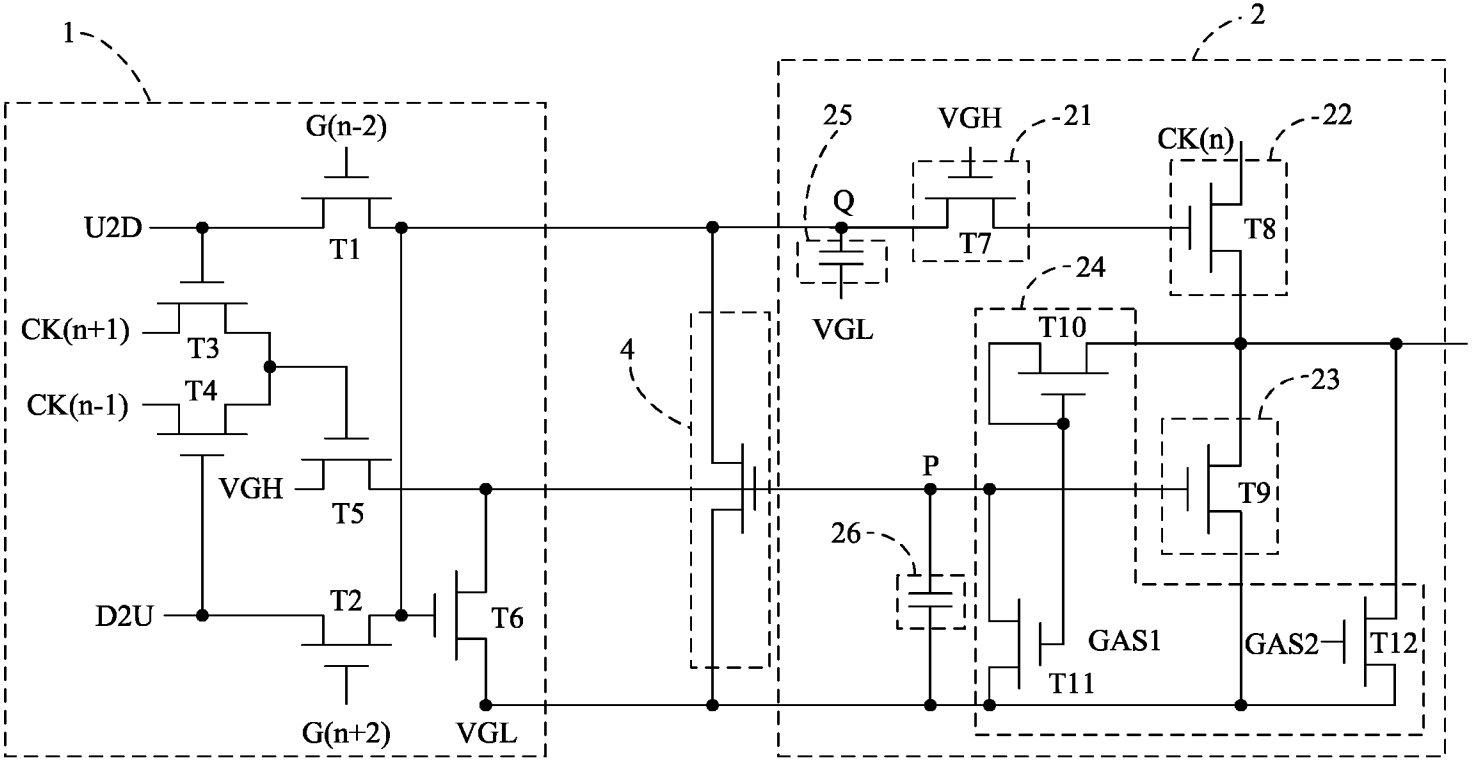
FIG. 3 is a schematic diagram of the GOA circuit which is not been provided with a pull-up supplement module.

First, to observe the GOA circuit that does not have the pull-up supplement module (as shown in FIG. 3), wherein the signal GAS1 (which is at the gate of the eleventh switch T11) is in a state of a constant low voltage under normal operation. Within the touch control terms, voltage at the controllable terminal GAS2 is translated from the constant low voltage (Low) in a normal display state to a high voltage (High). Generally, the current panel type of ITP needs that several touch panel (TP) terms are inserted within displaying time over a single frame to achieve touch function. Meanwhile, an NMOS type GOA circuit must hold the high voltage for requirement of cascaded transmission by the first energy storing element 25. However, the NMOS TFT is not an ideal switch. Even if the NMOS TFT is in a case of an off state, there will still be a certain leakage current. If the pause stage for the TP needs to maintain a high voltage for a long time, the leakage current will reduce stability of cascaded transmission of the GOA.

On the other hand, after the above-described pull-up supplement module 3 is set in the GOA circuit, taking the first embodiment as an example, as shown in the FIG. 1, the first end of the leakage switch 4 is electrically connected to the first end of the auxiliary switch Tb. When the first node Q is in high voltage of the cascaded holding state, in particular to in the holding state of the TP terms, the leakage switch 4 is turned off and has a certain leakage current (from the first node Q to the low voltage terminal VGL), that decreases the voltage at the first node Q. However, it should be noted that, at the same time, the supplementary switch Ta is also in an off state, and there is also a certain leakage current (from the high voltage terminal VGH to the first node Q), that increases the voltage at the first node Q, thereby relieving influence of leakage current of the leakage switch to the voltage at the first node Q. Therefore, a control margin of the circuit during a touch period is increased, so that the circuit operates normally and reliability of the circuit is improved.

Furthermore, the auxiliary switch Tb may be operated as a normal-open type TFT, but even if that is in an ON state, the resistance of the TFT can also reach a mega-ohm level, that can assist in partially reducing the leakage current of the leakage switch 4. In addition, as shown in FIG. 1, the voltage on the left side of the auxiliary switch Tb is theoretically slightly higher than the right side, and the voltage on the left side of the auxiliary switch Tb is also the voltage of the control end (gate) of the supplementary switch Ta. It is advantageous for the supplement switch Ta leaking current to the first node Q, so that the first node Q maintains a high voltage to ensure that the circuit works normally.

It should be noted that, although the leakage current of the leakage switch 4 still reduces the voltage at the first node Q, an electrical leakage path of the leakage switch 4 according to the present disclosure is not cut off, that is different from and the GOA circuit in the prior art that cuts off the electrical leakage path. Instead, the pull-up supplement module 3 instantaneously supplies electrical power to the first energy storing element 25 with the leakage current characteristic of the supplement switch Ta, thereby relieving influence of leakage current of the leakage switch 4. Further, the voltage at the first node Q is maintained roughly to ensure that the circuit operates normally, and the panel of the display device is prevented from a split-screen phenomenon.

Furthermore, as shown in FIG. 2, the GOA circuit of the second embodiment of the present disclosure is also provided with the pull-up supplement module 3, for example, the first end of the leakage switch 4 is electrically connected to the second end of the auxiliary switch Tb. Compared with the first embodiment, the advantages of the present embodiment are that it is more conducive to the cascaded transmission. In the cascaded transmission process, the first switch T1 can rapidly raise the voltage of the control end (gate) of the sixth switch T6, thereby quickly turning off the leak switch 4 to complete the cascaded transmission. Correspondingly, the requirement of the voltage of the control end (gate) of the first switch T1 may be less than that of the first embodiment, so that the GOA circuit maintains the normal function even after experiencing the TP term, and the panel of the display device is prevented from the split-screen phenomenon.

It should be understood that, a driving architecture of the above GOA circuit can be interlaced or double-driven. A phase topology of 4CK, 6CK or 8CK may be used in the GOA circuit. Take the 4CK as an example. Two GOA circuits are taken as one cycle. Two identical GOA circuits can be used as a first GOA circuit and a second GOA circuit, and four clock signals (i.e., CK1, CK2, CK3, CK4) are input to the first GOA circuit and the second GOA circuit. For example, as shown in FIG. 1 and FIG. 2, the signal CK1 may be input to the n-th clock terminal CK(n) of the first GOA circuit, the signals CK2, and the CK4 are input to the (n+1)th clock terminal CK(n+1) and the (n−1)th clock terminal of the first GOA circuit and the second GOA circuit, and the signal CK3 is input the n-th clock terminal CK(n) of the second GOA circuit. It can be understood by those skilled in the art, and will not be described here.

Another aspect of the present disclosure provides a display device, which includes an array substrate and the GOA circuit as above described, wherein the GOA circuit is disposed on the array substrate. The display device may be configured to one of devices as follows: any product or component having a display function, such as a liquid crystal panel, an electronic paper, an organic light-emitting diode (OLED) panel, a mobile phone, a tablet computer, a television, a display, a notebook computer, a digital camera, a navigator, etc., the display device can solve the same problem and produce the same effect as the above GOA circuit.

The present disclosure has been described by the above related embodiments, but the above embodiments are merely examples for implementing the present disclosure. It must be noted that the disclosed embodiments do not limit the scope of the disclosure. On the contrary, it includes that modifications and equalization settings within the spirit and scope of the claims are within the scope of the present disclosure.

What is claimed is:

1. A gate driver on array (GOA) circuit, comprising a plurality of cascaded sub-circuits, wherein an n-th sub-circuit of the sub-circuits comprises:

a control module electrically connected to a positive scan control terminal, a negative scan control terminal, an (n−2)th scan terminal, an (n+2)th scan terminal, an (n+1)th clock terminal, an (n−1)th clock terminal, a high voltage terminal, and a low voltage terminal;

an output module electrically connected to the high voltage terminal, the low voltage terminal, an n-th clock terminal, an n-th scan terminal, and a controllable terminal;

a pull-up supplement module comprising a supplement switch and an auxiliary switch, wherein the supplement switch is electrically connected to the auxiliary switch, the high voltage terminal, the control module, and the output module, and the auxiliary switch is electrically connected to the supplement switch, the high voltage terminal, the control module, and the output module; and a leakage switch electrically connected to the control module, the output module, the supplement switch, the auxiliary switch, and the low voltage terminal;

wherein the control module comprises a first switch, a second switch, a third switch, a fourth switch, a fifth switch, and a sixth switch; wherein the first switch is electrically connected to the (n−2)th scan terminal, the positive scan control terminal, the second switch, the sixth switch, the supplement switch, and the auxiliary switch; wherein the second switch is electrically connected to the (n+2)th scan terminal, the negative scan control terminal, the first switch, the sixth switch, the supplement switch, and the auxiliary switch; wherein the third switch is electrically connected to the positive scan control terminal, the (n+1)th clock terminal, the fourth switch, and the fifth switch; wherein the fourth switch is electrically connected to the negative scan control terminal, the (n−1)th clock terminal, the third switch, and the fifth switch; wherein the fifth switch is electrically connected to the high voltage terminal, the third switch, the fourth switch, the sixth switch, the leakage switch, and the output module; and wherein the sixth switch is electrically connected to the low voltage terminal, the first switch, the second switch, the fifth switch, the supplement switch, the auxiliary switch, the output module, and the leakage switch; and wherein the output module comprises a relay unit, a pull-up unit, a pull-down unit, a detection unit, a first energy storing element, and a second energy storing element; wherein the relay unit is electrically connected to the high voltage terminal, the supplement switch, the auxiliary switch, and the pull-up unit; wherein the relay unit, the supplement switch, and the auxiliary switch are commonly connected to form a first node; wherein the pull-up unit is electrically connected to the relay unit, the n-th clock terminal, and the n-th scan terminal; wherein the pull-down unit is electrically connected to the n-th scan terminal, the low voltage terminal, the leakage switch, and the control module; wherein the detection unit is electrically connected to the n-th scan terminal, the low voltage terminal, the controllable terminal, the pull-down unit, the leakage switch, and the control module; wherein the pull-down unit, the detection unit, the leakage switch, and the control module are commonly connected to a second node; wherein the first energy storing element is electrically connected between the first node and the low voltage terminal; and wherein the second energy storing element is electrically connected between the second node and the low voltage terminal.

2. The GOA circuit as claimed in claim 1, wherein a control end of the supplement switch is electrically connected to a first end of the auxiliary switch and the control module; a first end of the supplement switch and a control end of the auxiliary switch are electrically connected to the high voltage terminal; and a second end of the supplement switch is electrically connected to a second end of the auxiliary switch and the output module.

3. The GOA circuit as claimed in claim 2, wherein a control end of the leakage switch is electrically connected to the control module and the output module; a first end of the leakage switch is electrically connected to the first end of the auxiliary switch or the second end of the auxiliary switch; and a second end of the leakage switch is electrically connected to the low voltage terminal.

4. The GOA circuit as claimed in claim 1, wherein the relay unit comprises a seventh switch; a control end of the seventh switch is electrically connected to the high voltage terminal; a first end of the seventh switch is electrically connected to the first node; and a second end of the seventh switch is electrically connected to the pull-up unit.

5. The GOA circuit as claimed in claim 1, wherein the pull-up unit comprises an eighth switch; a control end of the eighth switch is electrically connected to the relay unit; a first end of the eighth switch is electrically connected to the n-th clock terminal; and a second end of the eighth switch is electrically connected to the n-th scan terminal.

6. The GOA circuit as claimed in claim 1, wherein the pull-down unit comprises a ninth switch; a control end of the ninth switch is electrically connected to the second node; a first end of the ninth switch is electrically connected to the n-th scan terminal; and a second end of the ninth switch is electrically connected to the low voltage terminal.

7. The GOA circuit as claimed in claim 1, wherein the detection unit comprises a tenth switch, an eleventh switch, and a twelfth switch; a control end of the tenth switch is electrically connected to a first end of the tenth switch and a control end of the eleventh switch; a second end of the tenth switch is electrically connected to the n-th scan terminal; a first end of the eleventh switch is electrically connected to the second node; a second end of the eleventh switch is electrically connected to the low voltage terminal; a control end of the twelfth switch is electrically connected to the controllable terminal; a first end of the twelfth switch is electrically connected to the n-th scan terminal; and a second end of the twelfth switch is electrically connected to the low voltage terminal.

8. A gate driver on array (GOA) circuit, comprising a plurality of cascaded sub-circuits, wherein an n-th sub-circuit of the sub-circuits comprises:

a control module electrically connected to a positive scan control terminal, a negative scan control terminal, an (n−2)th scan terminal, an (n+2)th scan terminal, an (n+1)th clock terminal, an (n−1)th clock terminal, a high voltage terminal, and a low voltage terminal;

an output module electrically connected to the high voltage terminal, the low voltage terminal, an n-th clock terminal, an n-th scan terminal, and a controllable terminal;

a pull-up supplement module comprising a supplement switch and an auxiliary switch, wherein the supplement switch is electrically connected to the auxiliary switch, and the high voltage terminal, the control module, and the output module, the auxiliary switch is electrically connected to the supplement switch, the high voltage terminal, the control module, and the output module; and a leakage switch electrically connected to the control module, the output module, the supplement switch, the auxiliary switch, and the low voltage terminal.

9. The GOA circuit as claimed in claim 8, wherein a control end of the supplement switch is electrically connected to a first end of the auxiliary switch and the control module; a first end of the supplement switch and a control end of the auxiliary switch are electrically connected to the high voltage terminal; and a second end of the supplement switch is electrically connected to a second end of the auxiliary switch and the output module.

10. The GOA circuit as claimed in claim 9, wherein a control end of the leakage switch is electrically connected to the control module and the output module; a first end of the leakage switch is electrically connected to the first end of the auxiliary switch or the second end of the auxiliary switch; and a second end of the leakage switch is electrically connected to the low voltage terminal.

11. The GOA circuit as claimed in claim 8, wherein the control module comprises a first switch, a second switch, a third switch, a fourth switch, a fifth switch, and a sixth switch; wherein the first switch is electrically connected to the (n−2)th scan terminal, the positive scan control terminal, the second switch, the sixth switch, the supplement switch, and the auxiliary switch; wherein the second switch is electrically connected to the (n+2)th scan terminal, the negative scan control terminal, the first switch, the sixth switch, the supplement switch, and the auxiliary switch; wherein the third switch is electrically connected to the positive scan control terminal, the (n+1)th clock terminal, the fourth switch, and the fifth switch; wherein the fourth switch is electrically connected to the negative scan control terminal, the (n−1)th clock terminal, the third switch, and the fifth switch; wherein the fifth switch is electrically connected to the high voltage terminal, the third switch, the fourth switch, the sixth switch, the leakage switch, and the output module; and wherein the sixth switch is electrically connected to the low voltage terminal, the first switch, the second switch, the fifth switch, the supplement switch, the auxiliary switch, the output module, and the leakage switch.

12. The GOA circuit as claimed in claim 8, wherein the output module comprises a relay unit, a pull-up unit, a pull-down unit, a detection unit, a first energy storing element, and a second energy storing element; wherein the relay unit is electrically connected to the high voltage terminal, the supplement switch, the auxiliary switch, and the pull-up unit; wherein the relay unit, the supplement switch, and the auxiliary switch are commonly connected to form a first node; wherein the pull-up unit is electrically connected to the relay unit, the n-th clock terminal, and the n-th scan terminal; wherein the pull-down unit is electrically connected to the n-th scan terminal, the low voltage terminal, the leakage switch, and the control module; wherein the detection unit is electrically connected to the n-th scan terminal, the low voltage terminal, the controllable terminal, the pull-down unit, the leakage switch, and the control module; wherein the pull-down unit, the detection unit, the leakage switch, and the control module are commonly connected to a second node; wherein the first energy storing element is electrically connected between the first node and the low voltage terminal; and wherein the second energy storing element is electrically connected between the second node and the low voltage terminal.

13. The GOA circuit as claimed in claim 12, wherein the relay unit comprises a seventh switch; a control end of the seventh switch is electrically connected to the high voltage terminal; a first end of the seventh switch is electrically connected to the first node; and a second end of the seventh switch is electrically connected to the pull-up unit.

14. The GOA circuit as claimed in claim 12, wherein the pull-up unit comprises an eighth switch; a control end of the eighth switch is electrically connected to the relay unit; a first end of the eighth switch is electrically connected to the n-th clock terminal; and a second end of the eighth switch is electrically connected to the n-th scan terminal.

15. The GOA circuit as claimed in claim 12, wherein the pull-down unit comprises a ninth switch; a control end of the ninth switch is electrically connected to the second node; a first end of the ninth switch is electrically connected to the n-th scan terminal; and a second end of the ninth switch is electrically connected to the low voltage terminal.

16. The GOA circuit as claimed in claim 12, wherein the detection unit comprises a tenth switch, an eleventh switch, and a twelfth switch; a control end of the tenth switch is electrically connected to a first end of the tenth switch and a control end of the eleventh switch; a second end of the tenth switch is electrically connected to the n-th scan terminal; a first end of the eleventh switch is electrically connected to the second node; a second end of the eleventh switch is electrically connected to the low voltage terminal; a control end of the twelfth switch is electrically connected to the controllable terminal; a first end of the twelfth switch is electrically connected to the n-th scan terminal; and a second end of the twelfth switch is electrically connected to the low voltage terminal.

17. A display device, comprising an array substrate and the GOA circuit as claimed in claim 8, wherein the GOA circuit is disposed on the array substrate.

* * * * *